US005099639A

United States Patent [19]

Grau et al.

[11] Patent Number: 5,099,639

[45] Date of Patent: Mar. 31, 1992

[54] APPARATUS FOR SELECTIVELY RESISTING THE ROTATION OF SPINDLES OF A TEXTILE MACHINE

[75] Inventors: Gerhard Grau, Müllheim; Hermann Güttler, Uhingen, both of Fed. Rep. of Germany

[73] Assignee: Zinser Textilmaschinen GmbH, Ebersbach/Fils, Fed. Rep. of Germany

[21] Appl. No.: 647,762

[22] Filed: Jan. 30, 1991

Related U.S. Application Data

[62] Division of Ser. No. 438,512, Nov. 17, 1989, Pat. No. 5,044,149.

[30] Foreign Application Priority Data

Nov. 18, 1988 [DE] Fed. Rep. of Germany ..... 3839026

[51] Int. Cl.[5] ..... D01H 13/14

[52] U.S. Cl. ..... 57/88; 57/100

[58] Field of Search ..... 57/78, 88, 100

[56] References Cited

U.S. PATENT DOCUMENTS

| | | | |
|---|---|---|---|
| 3,108,428 | 10/1963 | Mortensen | 57/78 |
| 3,426,520 | 2/1969 | Bucher et al. | 57/88 |
| 3,599,415 | 8/1971 | Jaeggli | 57/88 |
| 3,805,504 | 4/1954 | Franzen | 57/88 X |
| 3,950,931 | 4/1976 | Bleeck | 57/78 X |
| 4,028,873 | 6/1977 | Schulz et al. | 57/78 X |
| 4,336,684 | 6/1982 | Hartmannsgruber et al. | 57/100 X |
| 4,817,371 | 4/1989 | Wolf | 57/100 |
| 4,908,534 | 3/1990 | Gubler et al. | 57/100 X |

FOREIGN PATENT DOCUMENTS

| | | | |
|---|---|---|---|
| 432315 | 9/1967 | Switzerland | 57/88 |

*Primary Examiner*—Joseph J. Hail, III

*Attorney, Agent, or Firm*—Shefte, Pinckney & Sawyer

[57] ABSTRACT

A rotation preventing apparatus presents rotation of the spindles of a textile machine due to the rotative forces applied by yarn tension during de-actuation of the drive motors of the spindles. The rotation preventing apparatus includes a reciprocable member supporting a plurality of brake shoe components adjacent the spindles and a commonly actuating assembly including pneumatic cylinder and piston members for reciprocably moving the reciprocable member between a position in which the brake shoe components brakingly contact the spindles and a position in which the brake shoe components are displaced from the spindles to permit normal rotation thereof. According to one aspect of the present invention, a contoured plate member is substituted for the brake shoe components. According to another aspect of the present invention, an expandable elastomeric member is supported adjacent the spindles and is selectively expandable to brake the rotation of the spindles.

2 Claims, 3 Drawing Sheets

Fig. 2
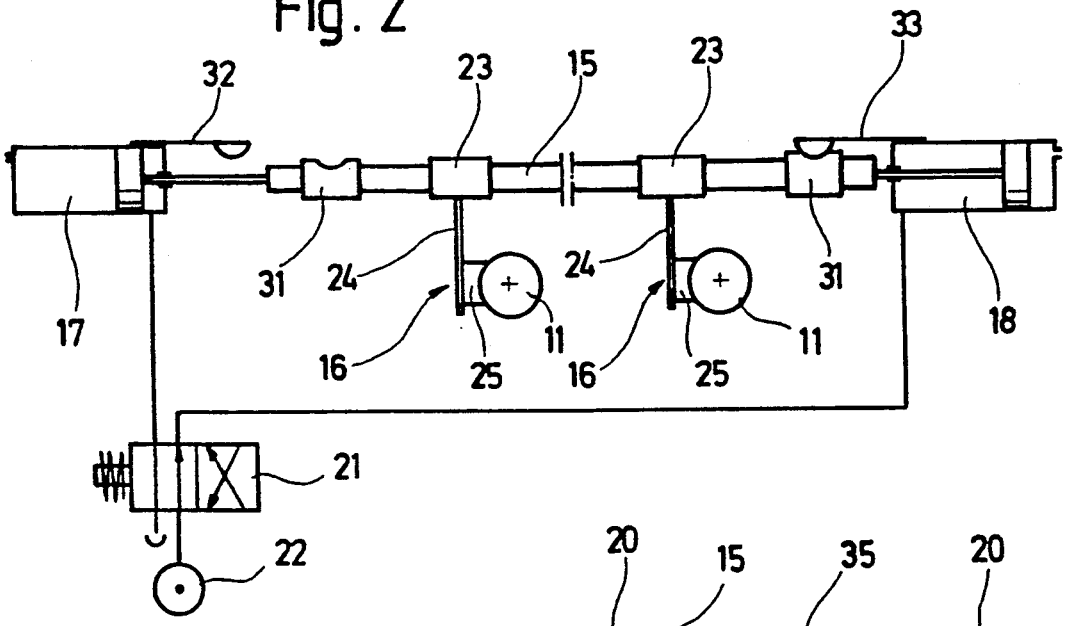
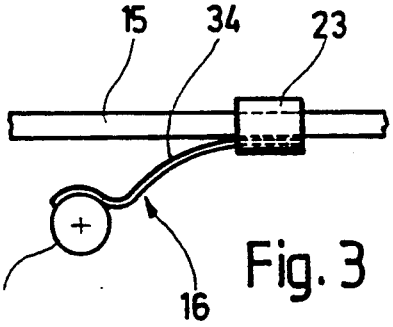
Fig. 3
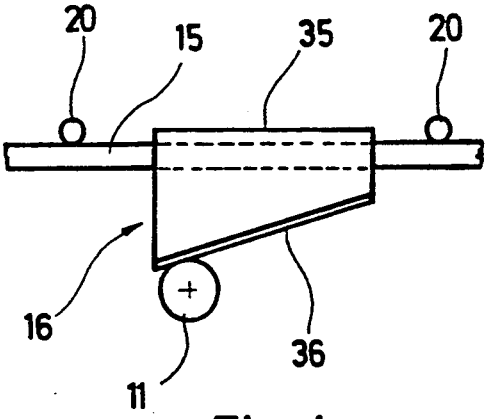
Fig. 4
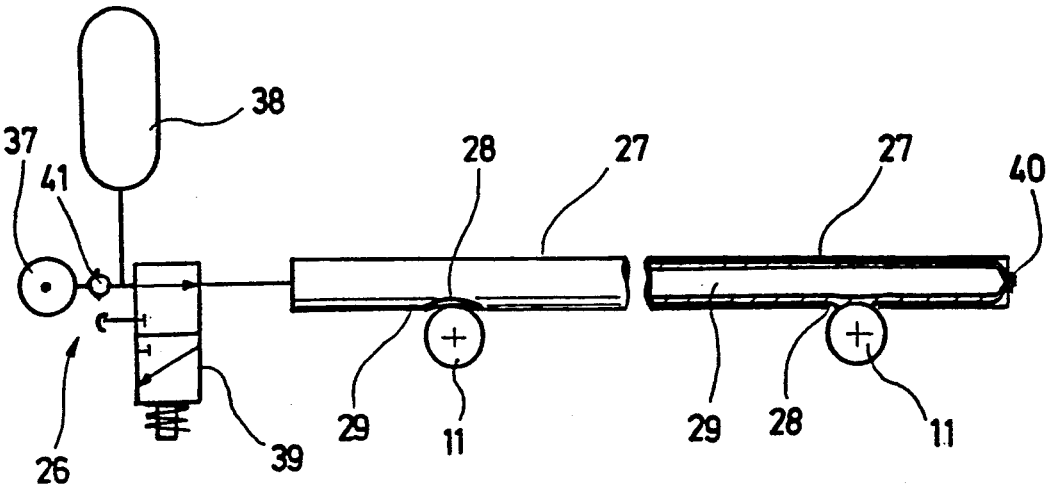
Fig. 5

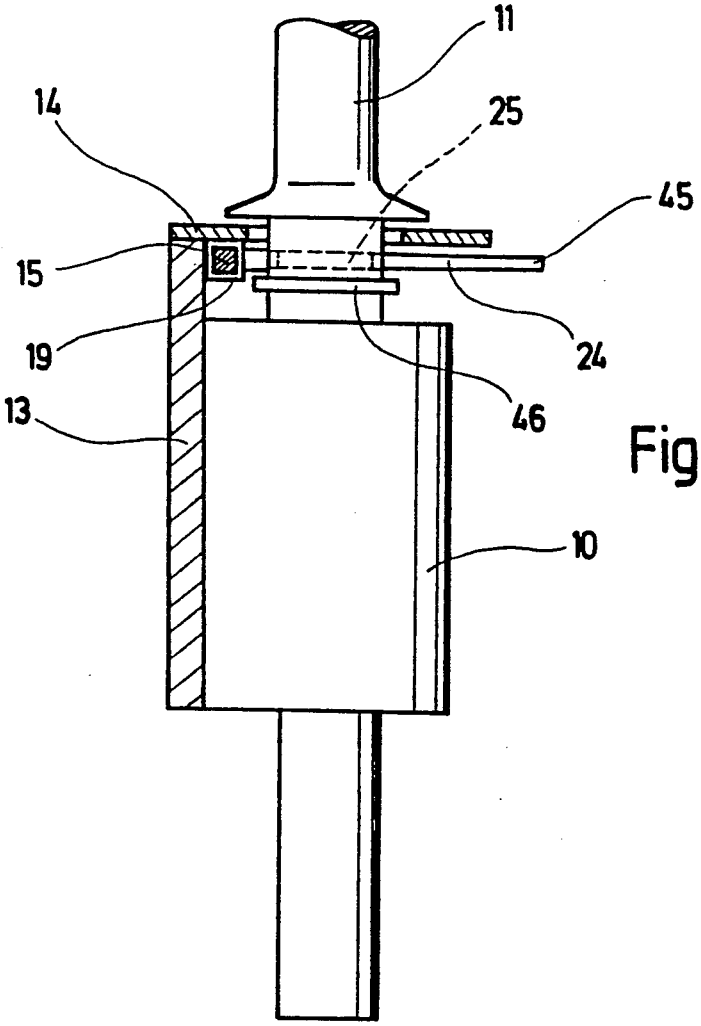
Fig. 6
Fig. 7
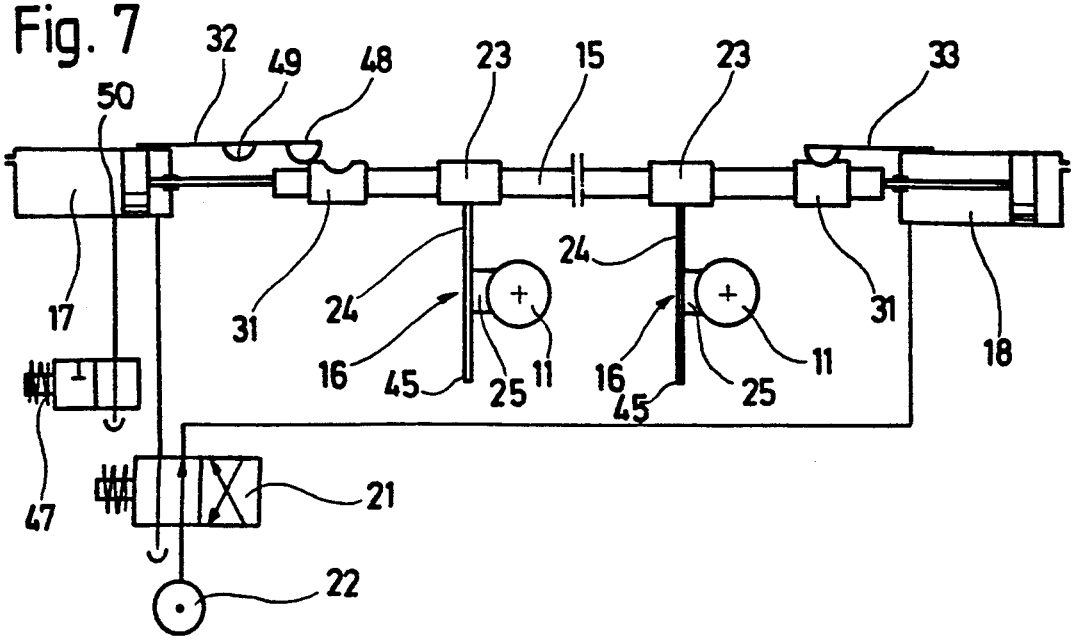

APPARATUS FOR SELECTIVELY RESISTING THE ROTATION OF SPINDLES OF A TEXTILE MACHINE

This is a divisional of co-pending application Ser. No. 483,512, filed Nov. 17, 1989 now U.S. Pat. No. 5,044,149.

BACKGROUND OF THE INVENTION

The present invention relates to an apparatus for selectively resisting the rotation of the spindles of a textile machine and, more particularly, for resisting the rotation of the spindles when the spindle drive motors are de-activated.

In certain types of textile machines such as, for example, ring spinning machines, it is known to provide electric motors for each individual spindle for driving of the spindle. In practice, the occurrence of yarn breaks during operations such as package doffing or idling of the machine is considerably higher with spinning machines than with other types of textile machines. Yarn breaks occur during idling or non-operation of the spinning machine, for example, because the spindles thereon do not immediately assume a non-rotating disposition after the drive motors for driving the spindles have been de-activated. Instead, conditions such as yarn tension and vibrations may cause the spindles to rotate oppositely to their normal winding direction of rotation and this counter-rotation increases the risk that twisting and snarling will occur. The occurrence of twisting and snarling, in turn, increases the risk that a yarn break will later occur.

Accordingly, the need exists for an apparatus which effectively prevents undesired rotation of the spindles of a textile machine when the spindle drive motors are de-activated.

SUMMARY OF THE INVENTION

The present invention provides an apparatus which selectively prevents rotation of the spindles of a textile machine when the spindle drive motors are de-activated to prevent rotation of the yarn packages supported on the spindles.

Briefly described, the rotation preventing apparatus of the present invention is incorporated in a textile machine of the type having a frame supporting a spindle bank and a plurality of spindles extending in a line along the spindle bank, each spindle supporting a tube onto which a yarn package is built and being rotatably supported on the spindle bank and individually rotatably driven by a drive motor, each drive motor being selectively activated to drive the associated spindle and de-activated to cease driving of the spindle. The rotation preventing apparatus is in the form of means acting individually on each spindle for resisting rotation of the spindles to prevent rotation of the yarn packages supported on the spindles when the drive motors of the spindles are de-activated.

Preferably, the rotation preventing apparatus includes means for commonly actuating the rotation resisting means to act on all spindles simultaneously, with the commonly actuating means including a reciprocable member having opposite ends and supported on the textile machine for selected reciprocating movement and a device for reciprocating the reciprocable member. The commonly actuating means further includes a plurality of lateral projections projecting laterally from the reciprocable member at spaced intervals therealong, with the lateral projections supporting the rotation resisting means.

In one form of the invention, the rotation resisting means includes a plurality of brake shoe components, each brake shoe component being mounted on a respective one of the lateral projections and supported thereby adjacent a respective one of the spindles. The brake shoe components are configured for selectively brakingly contacting the spindles to resist rotation thereof and the reciprocable member being movable between a braking position in which the brake shoe components are positioned in braking contact with their respective associated spindles and a non-braking position in which the brake shoe components are displaced from their respective associated spindles. Preferably, the device for reciprocally moving the reciprocable member includes a pair of drive assemblies, each drive assembly being connected to a respective reciprocal end of the reciprocable members, and a control device connected to the drive assemblies for actuating each drive assembly in coordinated, alternating manner to effect reciprocal movement of the reciprocable member. Each of the drive assemblies includes a pair of pneumatic cylinder and piston devices, each pneumatic device being positioned at a respective end of the reciprocable member and each piston being coupled to a respective end of the reciprocable member. The control device alternately controlling one of the pneumatic devices to retract its piston and correspondingly controls the other of the pneumatic devices to extend its piston in response to the retraction of the piston of the one pneumatic device.

A device is preferably provided for selectively opposing movement of the reciprocable member from the braking position to the non-braking position when the device for reciprocally moving the reciprocable member is de-activated. In the preferred embodiment, this device for selectively opposing movement includes a recess formed in a selected one of the reciprocable member and the frame of the textile machine and a recess engaging member mounted to the other of the reciprocable member and the frame of the textile machine, the recess engaging member has a portion movable transversely with respect to the direction of reciprocation of the reciprocable member and is resiliently biased toward the reciprocable member to automatically engage the recess when the recess is aligned with the recess engaging member and resist movement of the reciprocable member. The recess and the recess engaging member are disposed adjacent a selected respective one of the ends of the reciprocable member for opposing movement of the reciprocable member from the non-braking position to the braking position.

In another form of the present invention, the rotation resisting means includes a reciprocable member supported on the frame of the textile machine for selected reciprocating movement, means for selectively reciprocally moving the reciprocable member, and a tapered surface braking device mounted to the reciprocable member for movement therewith. The tapered surface braking device includes a tapered surface extending at an angle with respect to the axis of movement of the reciprocable member, the tapered surface braking device being movable by the reciprocable member into a braking position in which the tapered surface contacts a spindle to resist rotation thereof and a non-braking position in which the tapered surface is displaced from the spindle.

In an alternate form of the present invention, the rotation resisting means includes a plurality of resiliently deflectable members secured to the reciprocable member at spaced intervals therealong and resiliently biased transversely outwardly therefrom for resilient deflection in a direction transversely toward the reciprocable member during engagement with the spindles.

In another embodiment of the present invention the rotation resisting means includes an expansion member, means for supporting the expansion member adjacent the spindles and a expansion control means. The expansion member has a chamber for receiving a fluid expandable upon introduction of a fluid therein and the expansion control means includes means for selectively supplying fluid to and withdrawing fluid from the chamber of the expansion member to cause selective expansion and contraction of the expansion member, the expansion member being expandable into contact with the spindles to prevent rotation thereof and contractable to permit rotation of the spindles. Preferably, the means for supporting the expansion member includes a housing having openings at spaced intervals therealong in correspondence with the spindles and the expansion member is selectively expandable outwardly through the openings into contact with the spindles to prevent rotation of the spindles.

In a further embodiment of the present invention, each spindle has a withdrawal engagement portion and the brake shoe components include means for engaging the withdrawal engagement portions of the spindles in the braking position to resist vertical movement of the spindles relative to the spindle bank. Preferably, the reciprocable member is operable to move the brake shoe components to a spindle withdrawal preventing position in which the brake shoe components are displaced from braking contact with the spindles and in position for engaging the withdrawal engagement portions of the spindles to resist vertical movement of the spindles relative to the spindle bank.

BRIEF DESCRIPTION OF THE DRAWINGS

FIG. 2 is a plan view of the rotation preventing apparatus shown in FIG. 1;

FIG. 3 is a partial plan view of another embodiment of the rotation preventing apparatus of the present invention;

FIG. 4 is a partial plan view of a further embodiment of the rotation preventing apparatus of the present invention;

FIG. 5 is a plan view of yet another embodiment of the rotation preventing apparatus of the present invention;

FIG. 6 is a vertical sectional view of a portion of a spindle bank of a spinning machine incorporating an additional embodiment of the rotation preventing apparatus of the present invention; and FIG. 7 is a plan view of the additional embodiment of the rotation preventing apparatus shown in FIG. 6.

DETAILED DESCRIPTION OF THE PREFERRED EMBODIMENTS

Figure 1:
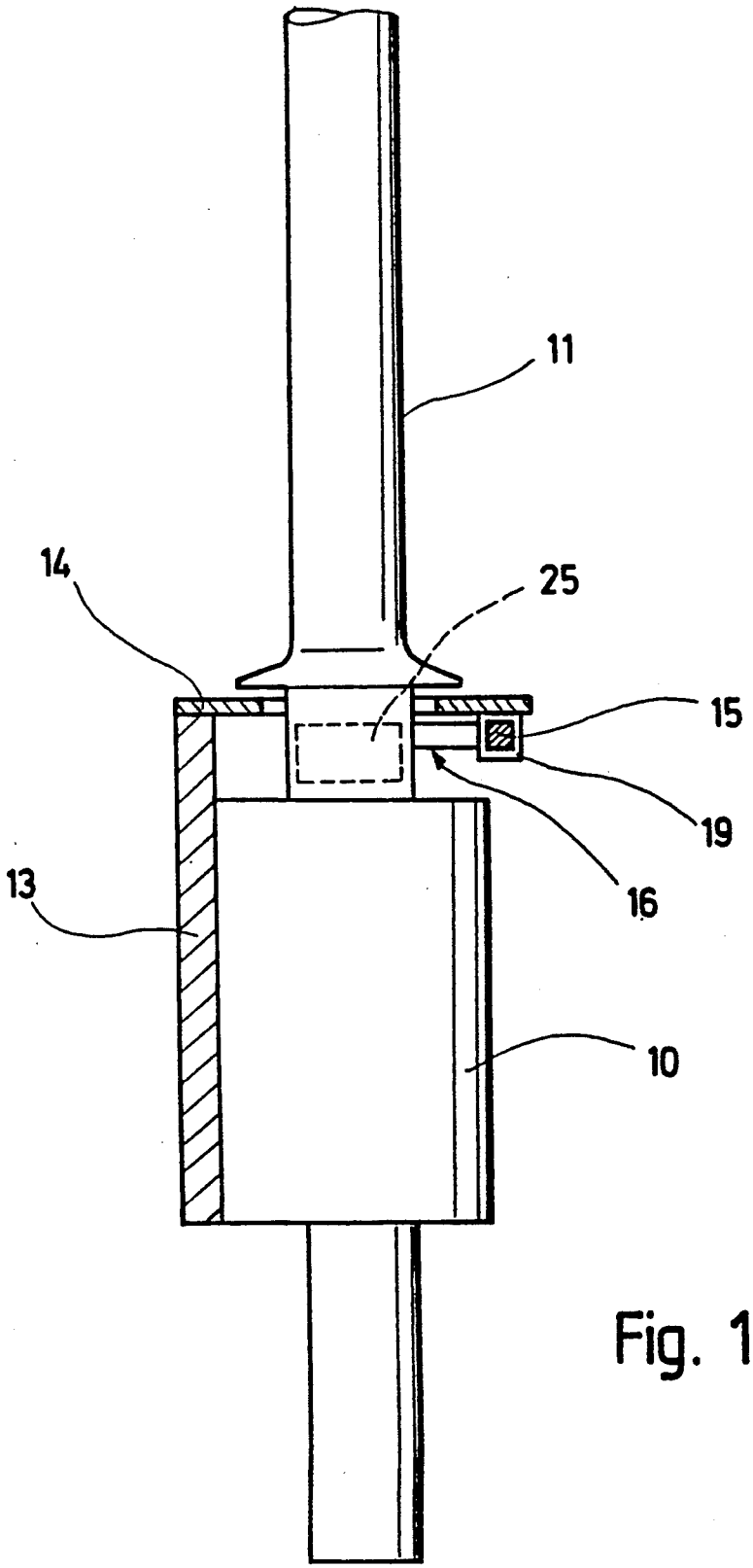
FIG. 1 is a vertical sectional view of a portion of a spindle bank of a spinning machine incorporating one embodiment of the rotation preventing apparatus of the present invention.

In FIGS. 1 and 2, one embodiment of the rotation preventing apparatus of the present invention is illustrated. A textile machine such as, for example, a ring spinning machine (not shown) includes a frame supporting a spindle bank 13 and a plurality of spindles 11 extending in a line along the spindle bank 13. Each spindle 11 supports a conventional tube (not shown) onto which a yarn package is built and each spindle is rotatably supported on the spindle bank 13 for individual rotation by a conventional drive motor 10. Each drive motor 10 is selectively activated to drive the associated spindle 11 and de-activated to cease driving of the spindle.

The rotation preventing apparatus includes a means 16 acting individually on each spindle for resisting rotation of the spindles to prevent rotation of the yarn packages supported on the spindles when the drive motors 10 of the spindles are de-activated. The rotation resisting means 16 includes a means for commonly actuating the rotation resisting means to act on all the spindles 11 simultaneously. The commonly actuating means includes a reciprocable member 15 having opposite ends and supported on the spindle bank 13 by a bracket 14 for reciprocating movement. Additionally, the commonly actuating means includes a device for reciprocating the reciprocable member 15 having a conventional pneumatic cylinder and piston assembly 17 operatively connected to one respective end of the reciprocable member 15 and a second conventional pneumatic cylinder and piston assembly 18 operatively connected to the other respective end of the reciprocable member 15. The pneumatic cylinder and piston assemblies 17,18 are commonly connected to a conventional electromagnetic valve assembly 21 which controls the supply of compressed fluid from a conventional compressed fluid source 22 to the pneumatic cylinder and piston assemblies 17,18, in a manner described in more detail below.

The rotation resisting mean 16 includes a plurality of securement sleeves 23 secured to the reciprocable member 15 at axial spacings therealong, a plurality of spring plate members 24, each secured at one respective end to a securement sleeve 23 and extending therefrom transversely with respect to the reciprocable member 15, and a plurality of brake shoe components 25, each mounted to a respective one of the spring plate members 24 adjacent its free end. The securement sleeves 23 and the spring plate members 24 support the brake shoe components 25 in respective positions adjacent the spindles 11. Each brake shoe component 25 includes an arcuate surface portion compatibly configured with the outer diameter of the spindles 11 for braking contact with a circumferential portion of the spindle. The reciprocable member 15 is selectively movable by the pneumatic cylinder and piston assemblies 17, 18, in a manner described in more detail below, to move the brake shoe components 25 into braking contact with the spindles 11 to resist rotation thereof during de-activation of the drive motors 10.

The rotation preventing apparatus additionally includes a device for selectively opposing movement of the reciprocable member 15 when the pneumatic cylinder and piston assemblies 17,18 are deactivated. The selective movement opposing device includes a pair of recess members 31, each having a recess formed therein and secured to the reciprocable member 15 adjacent one respective end thereof, a recess engaging member 32 mounted to the pneumatic cylinder and piston assembly 17 and extending in spaced, parallel disposition to the reciprocable member 15, and a recess engaging member 33 mounted to the pneumatic cylinder and piston assembly 18 and extending in spaced, parallel disposition to the reciprocable member 15.

In operation, the rotation preventing apparatus illustrated in FIGS. 1 and 2 advantageously prevents rotation of the spindle 11 when the drive motors 10 of the spindles are de-activated. Experience has shown that a spindle drive motor such as, for example, a synchronous motor, does not sufficiently resist rotation forces acting on the associated spindle during the period of time in which the drive motor is de-activated. For example, if the drive motor is de-activated during a doffing operation or during a shut-down of the ring spinning machine, the tension on the yarn being wound onto the tube supported on the associated spindle may be of sufficient magnitude to exert a rotative force on the spindle to cause rotation thereof. Rotation of the spindle creates the risk that snarls or loops will occur in the yarn package which can detrimentally lead to interruptions in further handling of the yarn such as, for example, yarn breaks. Accordingly, the rotation preventing apparatus of the present invention is operable to exert a slight braking force on the spindles 11 sufficient to resist the rotative forces exerted on the spindles by yarn tension. In this respect, the braking force exerted by the rotation preventing apparatus need not be so large as to be able to brake the rotation of a spindle while the spindle is still rotating about its axis; instead, the braking force need only be of sufficient magnitude to brake the spindle once the spindle has substantially stopped rotating about its axis.

In preparation for normal operation of the spindles 11 for building yarn packages on the tube supported thereon, the electromagnetic valve 21 is activated to permit compressed fluid to flow from the compressed fluid source 22 to the pneumatic cylinder and piston assembly 17 to cause retraction of its piston and to permit compressed fluid to be returned by the pneumatic cylinder and piston assembly 18 to the compressed fluid source 22 in correspondence with the movement of the reciprocable member 15 axially in the direction toward the pneumatic cylinder and piston assembly 17. As the piston of the pneumatic cylinder and piston assembly 17 continues its retraction movement, the recess of the recess member 31 moves into alignment with the recess engaging member 32 mounted on the pneumatic cylinder and piston assembly 17. In this regard, the recess engaging member 32 includes an enlarged portion adjacent its free end extending toward the reciprocable member 15 for engaging the recess of the recess member 31. Upon engagement of the recessed member 31 by the recess engaging member 32, the valve 21 is activated to prevent further supply of compressed fluid from the compressed fluid source 22 to the pneumatic cylinder and piston assembly 17. The recess engaging member 32 then prevents further axial movement of the reciprocable member 15.

When the recess member 31 is engaged by the recess engaging member 32, each of the brake shoe components 25 is positioned in a non-braking position displaced from its respective associated spindle 11. The spindles 11 thus are not subjected to any braking action by the brake shoe components 25 and are free to rotate about their axes during normal package building operation.

Upon de-activation of the drive motors 10, the spindles 11 are no longer driven and eventually cease rotating about their axes. In correspondence with the cessation of rotation of the spindles 11, the electromagnetic valve 21 is activated to permit compressed fluid to be supplied from the compressed fluid source 22 to the pneumatic cylinder and piston assembly 18 to effect axial movement of the reciprocable member 15 in the direction of the pneumatic cylinder and piston assembly 18. Additionally, the electromagnetic valve 21 permits compressed fluid to be returned from the pneumatic cylinder and piston assembly 17 to the compressed fluid source 22. The movement of the piston of the pneumatic cylinder and piston assembly 18 effects disengagement of the recessed member 31 from the recess engaging member 32 and, during continued axial movement of the reciprocable member 15, the brake shoe components 25 are moved into braking positions in which they are in braking contact with their respective associated spindles 11 for preventing rotation thereof.

In correspondence with the movement of the brake shoe components 25 into braking contact with the spindles 11, the recess of the recess member 31 adjacent the pneumatic cylinder and piston assembly 18 moves into alignment with the enlarged free end portion of the recess engaging member 33 and is engaged thereby. Accordingly, once the electromagnetic valve 21 is activated to cease the supply of compressed fluid to the pneumatic cylinder and piston assembly 18, the mutually engaged recess engaging member 33 and the recess member 31 prevent axial movement of the reciprocable member 15 to thereby maintain the brake shoe components 25 in braking contact with the spindles 11.

In FIG. 3, another embodiment of the rotation preventing apparatus of the present invention is illustrated. A reciprocable member 15 is axially reciprocated by an appropriate commonly actuating means (not shown) such as, for example, the arrangement of the pneumatic cylinder and piston assemblies 17,18, the electromagnetic valve 21 and the compressed fluid source 22 discussed with respect to the embodiment illustrated in FIGS. 1 and 2. A plurality of securement sleeves 23 (only one of which is shown) are secured to the reciprocable member 15 at axial positions therealong in correspondence with the location of the spindles 11 (only one of which is shown). A rotation resisting means 16 includes a plurality of contoured plate members 34 (only one of which is shown), each contoured plate member 34 being secured at one end to a respective one of the securement sleeves 23 and resiliently biased in a direction transversely outwardly from the reciprocable member 15 toward the spindles 11. Each contoured plate member 34 includes an arcuate surface portion adjacent its free end compatibly configured with the circumferential surface of the associated spindle 11 and the radius of each arcuate surface portion is centered on a line extending through the axes of the spindles 11.

In operation, the reciprocable member 15 is axially moved in a direction in which the contoured plated members 34 are displaced from their respective associated spindles 11. Upon de-activation of the drive motors 10 of the spindles 11 and in correspondence with the cessation of rotation of the spindles 11, the reciprocable member 15 is axially moved to bring the arcuate surface portions of the contoured plate members 34 into braking contact with the spindles 11. In this regard, the leading edge of the arcuate surface portion of the contoured plate members 34 contact their respective associated spindles 11 as the reciprocable member 15 axially moves, thereby causing the contoured plate members 34 to resiliently deflect in a direction transversely toward the reciprocable member 15. As the leading edge of each arcuate surface portion bears on the respective associated spindle, the contoured plate member 34 moves transversely outwardly with respect to the reciprocable member 15 to bring the arcuate surface portion of the contoured plate member 34 into braking contact with the associated spindle 11.

In FIG. 4, a further embodiment of the rotation preventing apparatus of the present invention is illustrated. A reciprocable member 15 is reciprocably axially movable by a commonly actuating means (not shown) identical to the commonly actuating means discussed with respect to the embodiment illustrated in FIGS. 1 and 2. A rotation resisting means 16 includes a plurality of tapered surface braking devices 35 (only one of which is shown) fixedly secured to the reciprocable member 15 at axial locations therealong in correspondence with the location of the spindles 11. Each tapered surface braking device 35 includes a tapered braking surface 36 extending at an angle with respect to the axis of the reciprocable member 15 and extending from a point located transversely outwardly from the reciprocable member 15 at a location greater than the transverse spacing of the reciprocable member 15 and the spindles 11 to a point located transversely intermediate the spindles 11 and the reciprocable member 15. A plurality of posts 20 secured to the frame of the ring spinning machine contact the reciprocable member 15 at spaced axial locations therealong to resist transverse movement of the reciprocable member 15 in a direction away from the spindles 11.

In operation, the reciprocable member 15 is axially moved to effect displacement of the tapered braking surfaces 36 from their respective associated spindles 11 during normal driving operation of the spindles 11. Upon de-activation of the drive motors 10 and in correspondence with the cessation of rotation of the spindles 11, the reciprocable member 15 is axially moved to bring the tapered braking surfaces 36 into braking contact with the spindles 11. Continued axial movement of the reciprocable member 15 effects increasing braking contact by the tapered braking surfaces 36 on the spindles 11 and, in this regard, the posts 20 act to counter any movement of the reciprocable member 15 in a direction transversely away from the spindles 11 to thereby maintain the tapered braking surfaces 36 in braking contact with the spindles 11.

In FIG. 5, yet another embodiment of the rotation preventing apparatus of the present invention is illustrated. The rotation preventing apparatus includes a expansion member 29 such as, for example, a conventional elastomeric bladder having a chamber for receiving a fluid and expandable upon introduction of a fluid therein, means 27 for supporting the expansion member 29 adjacent the line of spindles 11 and means 26 for selectively supplying fluid to, and withdrawing fluid from, the chamber of the expansion member 29 to cause selective expansion and contraction of the expansion member. The expansion member support means 27 is in the form of a cylindrical tube closed at both ends and the expansion member 29 is disposed therein. The expansion member supporting means 27 is fixedly mounted by appropriate conventional securement means to the frame of the ring spinning machine. The expansion member support means 27 is provided with a plurality of openings 28 located in correspondence with the spindles 11 for permitting the expansion member 29 to expand outwardly through the openings into braking contact with the spindles 11. The expansion member 29 is secured by appropriate conventional securement means at one end to one closed end of the expansion member support means 27.

The fluid supply and withdrawing means 26 includes a conventional valve 29 operatively connected to the expansion member 29, a storage member 38, a back flow preventing valve 41 and a compressed fluid source 37. The valve 39 is actuable to permit compressed fluids to be supplied from the compressed fluid source 37 into the expansion member 29 to effect expansion of the expansion member outwardly through the openings 28 into braking contact with the spindles 11. The storage member 38 assures that a sufficient volume of compressed fluid is available so that gradual, relatively small leakage of compressed fluid from the expansion member 29 during braking operation will not result in a reduction of the braking contact by the expansion member 29 against the spindles 11. The back flow preventing valve 41 operates in conventional manner during braking operation of the expansion member 29 to prevent compressed fluid from returning to the compressed fluid source 37.

To cease the braking operation of the expansion member 29, the valve 39 is actuated to permit return flow of the compressed fluid from the expansion member 29 to the compressed fluid source 37. As the compressed fluid exits the expansion member 29, the expansion member contracts inwardly through the openings 28 into the cylindrical tube of the expansion member supporting means 27. Accordingly, the expansion member 29 moves out of braking contact with the spindles 11 as it contracts inwardly through the openings 28. In this regard, the present invention contemplates that the expansion member 29 can be operatively connected to a conventional vacuum source to facilitate the contraction of the expansion member. Additionally, the present invention contemplates that the compressed fluid source 37 can be configured as a conventional compressed air source or a conventional compressed hydraulic fluid source.

In FIGS. 6 and 7, an additional embodiment of the rotation preventing apparatus of the present invention is illustrated. The rotation preventing apparatus includes a reciprocable member 15 having opposite ends each operatively connected to a conventional pneumatic cylinder and piston assembly 17 and 18. The pneumatic cylinder and piston assemblies 17,18 are operatively connected to an electromagnetic valve and a compressed fluid source 22 in the same manner as discussed with respect to the embodiment of the present invention illustrated in FIGS. 1 and 2. A means for resisting rotation 16 includes a plurality of securement sleeves 23, a plurality of spring plates 24 and a plurality of brake shoe components 25, each identical in structure and operation to their counterparts illustrated in the embodiment in FIGS. 1 and 2. A recess engaging member 33 having an enlarged free end portion is mounted to the pneumatic cylinder and piston assembly 18 for engaging a recess formed in a recess member 31 secured to the reciprocable member 15. Another recess engaging member 32 is mounted to the pneumatic cylinder and piston assembly 17 and includes an enlarged free end portion 48 and an enlarged intermediate portion 49.

A recess member 31 secured to the reciprocable member 15 adjacent the pneumatic cylinder and piston assembly 17 is selectively individually engageable with the enlarged free end portion 48 and the intermediate enlarged portion 49 of the recess engaging member 32 in a manner described in further detail below. A bleed off line 50 is operatively connected to the cylinder of the pneumatic cylinder and piston assembly 17 and is connected to an electromagnetic valve 47.

The rotation preventing apparatus illustrated FIGS. 6 and 7 is operable to prevent rotation of the spindles 11 in a manner similar to the embodiment of the apparatus illustrated in FIGS. 1 and 2. Additionally, the embodiment illustrated in FIGS. 6 and 7 is operable to prevent inadvertent or undesired vertical withdrawal of the spindles 11 from the spindle bank 13. In this regard, each of the spindles 11 is provided with a withdrawal engagement portion 46 in the form of a radially enlarged annular ring axially located on the spindle such that it is disposed below the brake shoe component 25. The brake shoe components 25 ar each configured with an arcuate surface portion having a radius slightly greater than the outer circumference of the portion of the spindle 11 which is brakingly contacted but of lesser radius than the annular ring of the withdrawal engagement portion 46 of the spindles 11.

In operation, the brake shoe components 25 are movable between a braking position, a non-braking, spindle release position and a position of preventing withdrawal of the spindles 11 from the spindle bank 13 during normal operation of the spindles. To position the brake shoe components 25 in their braking positions, the valve 21 is activated to permit supply of compressed fluid from the compressed fluid source 22 to the pneumatic cylinder and piston assembly 18 to cause retraction of its pistons. The valve 21 simultaneously permits compressed fluid to be returned from the pneumatic cylinder and piston assembly 17 to the compressed fluid source 22 during movement of the reciprocable member 15. The movement of the reciprocable member 15 brings the arcuate surface portions of the brake shoe components 25 into braking contact with their respective associated spindles 11. The enlarged free end portion of the recess engaging member 33 engages the recess in the recess member 31 upon alignment therewith so that the brake shoe components 25 are maintained in their braking positions once the valve 21 is activated to cease the flow of compressed fluid to the pneumatic cylinder and piston assembly 18.

To position the brake shoe components 25 in their spindle withdrawal preventing positions, the valve 21 is activated to supply compressed fluid from the compressed fluid source 22 to the pneumatic cylinder and piston assembly 17 to cause retraction of its piston and, simultaneously, to permit return of compressed fluid from the pneumatic cylinder and piston assembly 18 to the compressed fluid source 22. When the recess of the recess member 31 adjacent the pneumatic cylinder and piston assembly 17 moves into alignment with the enlarged free end portion 48 of the recess engaging member 32, the enlarged free end portion 48 engages the recess. The opening of the bleed line 50 into the cylinder of the pneumatic cylinder and piston assembly 17 is located such that the piston head of the piston clears beyond the opening when the enlarged free end portion 48 engages the recess member 31. Accordingly, any compressed fluid flowing to the cylinder of the pneumatic cylinder and piston assembly 17 thereafter is bled off by the bleed line 50 under the control of the electromagnetic valve 47 so that no further retraction of the piston occurs.

The extent of the movement of the reciprocal member 15 up until the engagement of the recess member 31 by the enlarged free end portion 48 is sufficient to move the brake shoe components 25 out of braking contact with the spindles 11. However, the brake shoe components 25 are not moved radially beyond the annular ring of the withdrawal engagement portion 46 of the spindles 11 so that the brake shoe components 25 and the annular rings remain in superposed disposition. Accordingly, vertical withdrawal of the spindles 11 from the spindle bank 14 is prevented by the brake shoe components 25. However, an operator can individually release the spindles 11 for vertical withdrawal by manual flexing of the spring plate member 24 to move the associated brake shoe component 25 radially beyond the annular ring of the respective spindle 11.

To move the brake shoe components 25 to their non-braking spindle release positions, the electromagnetic valve 47 is closed to prevent further flow of compressed fluid through the bleed line 50. Then, the valve 21 is activated to supply compressed fluid from the compressed fluid source 22 to the pneumatic cylinder and piston assembly 17 to cause further retraction of its piston and to simultaneously permit compressed fluid to return from the pneumatic cylinder and piston assembly 18 to compressed fluid source 22. The retraction movement of the piston of the pneumatic cylinder and piston assembly 17 effects disengagement of the recess member 31 from the enlarged free end portion 48 and eventually brings the recess member 31 into alignment with the intermediate enlarged portion 49 of the recess engaging member 32. At this displacement of the reciprocable member 15, all of the brake shoe components 2 have cleared radially beyond the annular ring of the withdrawal engagement portions 46 of the spindles 11 and the spindles can be readily removed. Upon engagement by the intermediate enlarged portion 49 in the recess of the recess member 31, the valve 21 is deactivated to cease the flow of compressed fluid to the pneumatic cylinder and piston assembly 17.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the c aims appended hereto and the equivalents thereof.

We claim:

1. A textile machine comprising:

a spindle bank;

a frame supporting the spindle bank and a plurality of spindles extending in a line along the spindle bank, each spindle supporting a tube onto which a yarn package is built and being rotatably supported on the spindle bank; and a rotation preventing apparatus including a plurality of drive motors each being associated with a respective spindle for driving rotation thereof and each drive motor being selectively activated to drive its respective associated spindle and de-activated to cease driving rotation of the spindle thereby permitting the rotation of the spindle to diminish and ultimately stop as the spindle comes to a standstill, and means acting individually on each spindle for resisting rotation of the spindles to prevent rotation of the yarn packages supported on the spindles when the drive motors of the spindles are de-activated, said rotation resisting means including an expansion member, means for supporting said expansion member, and an expansion control means, said expansion member having a chamber for receiving a fluid, said chamber being expandable upon introduction of a fluid therein, said expansion control means including means for selectively supplying fluid to, and permitting release of fluid from, said chamber to cause selective expansion and contraction of said expansion member, and said expansion member being expandable into rotation preventing engagement with the spindles to prevent rotation thereof and contractable out of rotation preventing engagement with the spindles to permit rotation thereof.

2. In a textile machine, a rotation preventing apparatus according to claim 1 and characterized further in that said means for supporting said expansion member includes a housing having openings at spaced intervals therealong in correspondence with the spindles, said expansion member being selectively expandable outwardly through said openings into contact with the spindles to prevent rotation of the spindles.

* * * * *